US005848330A

United States Patent [19]

Nakaue et al.

[11] Patent Number: 5,848,330

[45] Date of Patent: Dec. 8, 1998

[54] IMAGING UNIT

[75] Inventors: Takahisa Nakaue; Yoshifumi Okauchi; Yukihiro Ito; Naoyuki Ishida; Masahiko Miyazaki; Tetsuya Ichigotani; Shoji Hirano, all of Osaka, Japan

[73] Assignee: Mita Industrial Co., Ltd., Osaka, Japan

[21] Appl. No.: 965,891

[22] Filed: Nov. 7, 1997

[30] Foreign Application Priority Data

Nov. 15, 1996 [JP] Japan ..... 8-305149

[51] Int. Cl.[6] ..... G03G 15/04

[52] U.S. Cl. ..... 399/119; 399/110

[58] Field of Search ..... 399/110, 111, 399/113, 116, 119

[56] References Cited

U.S. PATENT DOCUMENTS 4,827,305 5/1989 Enoguchi et al. ..... 399/119
4,989,037 1/1991 Nagatsuna ..... 399/119 X
5,089,849 2/1992 Hiraoka ..... 399/119
5,291,242 3/1994 Takano ..... 399/119
5,298,948 3/1994 Kurisu ..... 399/119
5,331,378 7/1994 Baker et al. ..... 399/111

*Primary Examiner*—Sandra Brase
*Attorney, Agent, or Firm*—Beveridge, DeGrandi, Weilacher & Young, LLP

[57] ABSTRACT

An imaging unit includes a developer unit which is supported rotatably about a predetermined rotation axis thereof by means of a drum unit. Spacing regulation sleeves are respectively fitted around opposite ends of a support shaft of a developer roller for regulating a spacing between the photoreceptor drum and the developer roller. A driven gear is engaged with one end of the support shaft of the developer roller for integral rotation thereof, and adapted to be driven by a drive transmission gear. By utilizing a driving force applied to the driven gear, the developer unit is biased about the rotation axis to press one spacing regulation sleeve fitted around one end of the support shaft of the developer roller against the photoreceptor drum. The other spacing regulation sleeve fitted around the other end of the support shaft of the developer roller is resiliently pressed against the photoreceptor drum by means of a resilient member.

9 Claims, 6 Drawing Sheets

IMAGING UNIT

CROSS REFERENCE TO RELATED APPLICATION

This application claims priority benefits of Japanese Patent Application No. 8-305149 filed on Nov. 15, 1996 under 35 USC §119, the disclosure thereof being incorporated herein by reference.

BACKGROUND OF THE INVENTION

1. Field of the Invention

The present invention relates to an imaging unit which includes a drum unit having a photoreceptor drum and a developer unit having a developer roller and being detachable from the drum unit.

2. Description of Related Arts

Conventional imaging units are typically of an electrostatic type in which an electrostatic latent image formed on a photoreceptor drum is developed into a toner image by means of a developer unit.

Such an imaging unit employs a developer roller spaced a predetermined distance apart from the photoreceptor drum in an opposed relation as the means for the development of the electrostatic latent image. The developer roller is rotated with a toner-containing developer agent retained thereon in synchronization with the rotation of the photoreceptor drum to supply the toner onto the photoreceptor drum. Thus, the electrostatic latent image is developed by the toner.

If a spacing between the developer roller and the photoreceptor drum (so-called DS spacing) is changed, the amount of the developer agent to be supplied onto the photoreceptor drum is changed, whereby a formed image may have an image defect such as uneven density. For prevention of such an image defect, the spacing between the developer roller and the photoreceptor drum should be kept constant (e.g., about 0.1mm).

As the means for keeping the DS spacing constant, spacer rolls (spacing regulation sleeves) are employed which are disposed at opposite ends of the developer roller coaxially therewith and abut against the circumference of the photoreceptor drum. More specifically, opposite ends of a shaft of the developer roller are supported by the developer unit so as to be movable toward and away from the photoreceptor drum, and the spacer rolls are pressed against the photoreceptor drum by resiliently biasing the opposite ends of the shaft toward the photoreceptor drum by means of resilient members provided in the developer unit.

With this arrangement, however, a structure for movably supporting the shaft of the developer roller and a structure for resiliently biasing the shaft should be provided at each of the opposite ends of the developer roller. This results in a complicated unit construction and in increased production costs.

SUMMARY OF THE INVENTION

It is an object of the present invention to provide an imaging unit of the type in which its developer unit is pivotally supported, the imaging unit including a simplified positioning structure for positioning a developer roller with respect to a photoreceptor drum.

In accordance with one mode of the present invention to attain the aforesaid object, there is provided an imaging unit which includes a drum unit rotatably supporting a photoreceptor drum, and a developer unit supported with respect to the drum unit pivotally about a predetermined rotation axis thereof. The developer unit includes a casing, a developer roller, a support shaft having first and second ends and supporting the developer roller for integral rotation therewith, first and second spacing regulation sleeves respectively engaged with the first and second ends of the support shaft and adapted to abut against a circumference of the photoreceptor drum for regulating a spacing between the developer roller and the photoreceptor drum, a driven gear provided at the first end of the support shaft for integral rotation therewith, a drive transmission gear rotatably supported by the casing for transmitting a driving force to the driven gear, and a resilient member for pressing the second spacing regulation sleeve against the circumference of the photoreceptor drum.

The first end of the support shaft is rotatably supported in such a manner that radial movement thereof is restricted by the casing of the developer unit, while the second end of the support shaft is supported by the casing of the developer unit so as to be movable toward and away from the photoreceptor drum. The developer unit is adapted to be biased rotatively about the predetermined axis by the driving force transmitted from the drive transmission gear to the driven gear so that the first spacing regulation sleeve is pressed against the photoreceptor drum.

In this mode, the first spacing regulation sleeve engaged with the first end of the support shaft of the developer roller is pressed against the photoreceptor drum by utilizing the driving force to be applied for rotatively driving the developer roller. This obviates the need for additionally providing a spring member for biasing the developer roller toward the photoreceptor drum and a structure for supporting the spring member, thereby reducing the production costs with a reduced number of components and with a reduced number of assembling steps. It is noted that the second spacing regulation sleeve engaged with the second end of the support shaft of the developer roller is adapted to be biased against the photoreceptor drum by a resilient member in substantially the same manner as in the prior art.

The support shaft of the driven gear preferably receives a force exerted by the transmission of the driving force along a line which intersects a plane including a rotation axis of the photoreceptor drum and a rotation axis of the drive transmission gear and is inclined at an angle of 0 to 90degrees with respect to a plane including a rotation axis of the driven gear and the rotation axis of the photoreceptor drum. The first spacing regulation sleeve engaged with the first end of the support shaft of the developer roller provided with the driven gear can be pressed against the photoreceptor drum by the force exerted along the line defined above.

DESCRIPTION OF THE PREFERRED EMBODIMENT

One preferred embodiment of the present invention will hereinafter be described with reference to the attached drawings.

Figure 1:
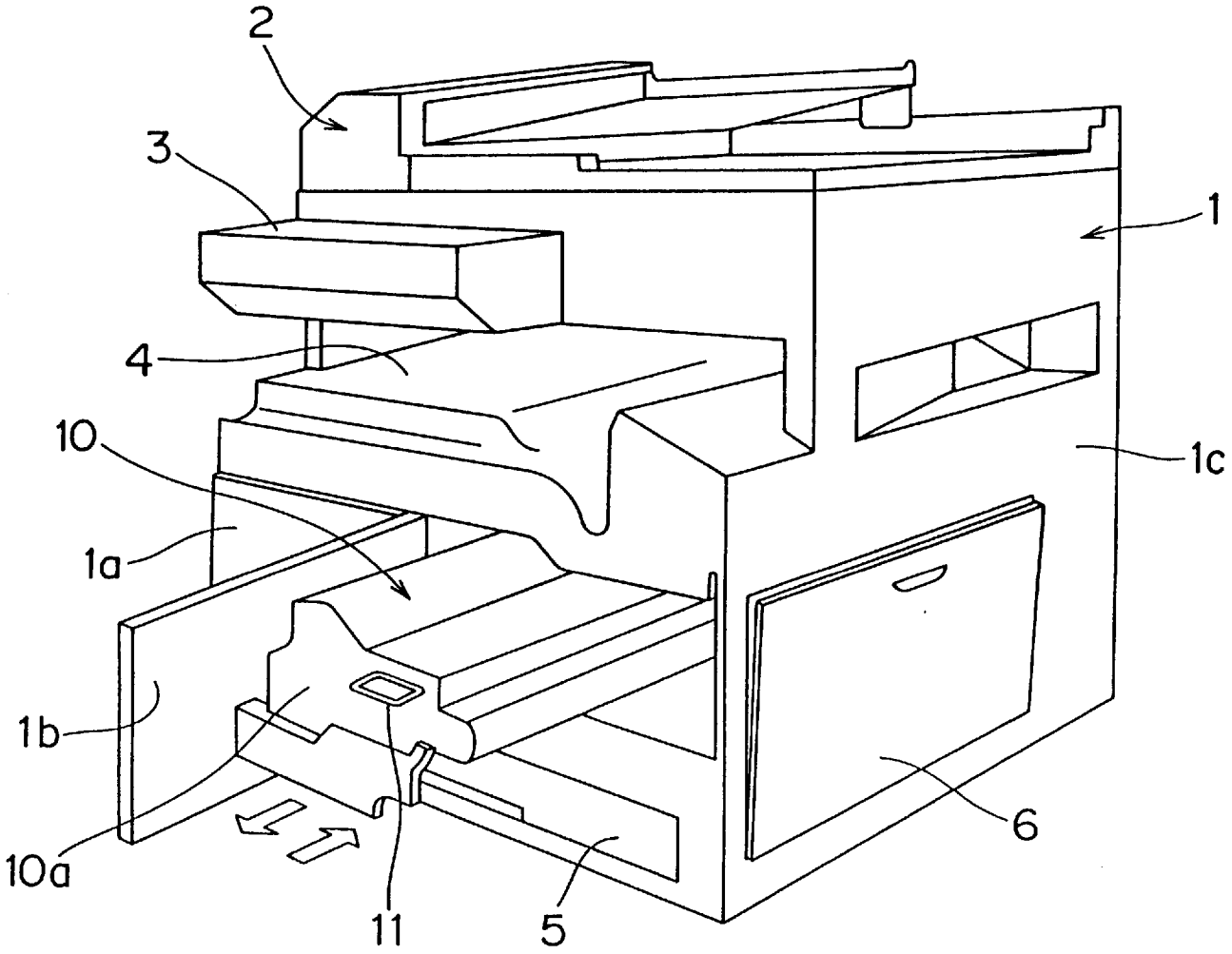
FIG. 1 a schematic perspective view illustrating an image forming apparatus including an imaging unit according to one embodiment of the present invention.

FIG. 1 is a schematic perspective view illustrating a state where an imaging unit according to the embodiment of the present invention is taken out of an image forming apparatus. It is noted that a side of the image forming apparatus opposite to a side from which the imaging unit is drawn out is hereinafter referred to as "first side" and the side from which the imaging unit is drawn out is hereinafter referred to as "second side".

The image forming apparatus has an automatic document feeder (ADF) 2 provided on a top face of an image forming apparatus body 1. An operation panel 3 is provided on a front upper portion of the image forming apparatus body 1. The operation panel 3 has various operation keys and a display portion. The image forming apparatus body 1 also has a sheet discharge portion 4 provided below the operation panel 3 and open to its front side.

An openable cover 1b is provided on a front face 1a of the image forming apparatus body 1. The cover 1b is opened to allow an imaging unit 10 to be inserted into or taken out of the image forming apparatus body 1 in directions indicated by white arrows. In FIG. 1, there are also shown a sheet cassette 5 which can be drawn forwardly of the image forming apparatus body 1, and a cover 6 provided on a side face 1c of the image forming apparatus body 1. When the cover 6 is slightly opened, a transfer unit (not shown) attached to the inside face of the cover 6 is spaced a predetermined distance apart from a photoreceptor drum of the imaging unit 10 so that the imaging unit 10 can readily be drawn forward. The imaging unit 10 has a raisable handle 11 provided on a drawing side end face lOa of the imaging unit 10 on the second side, so that a user can draw the imaging unit 10 forward by grasping the raised handle 11.

Figure 2:
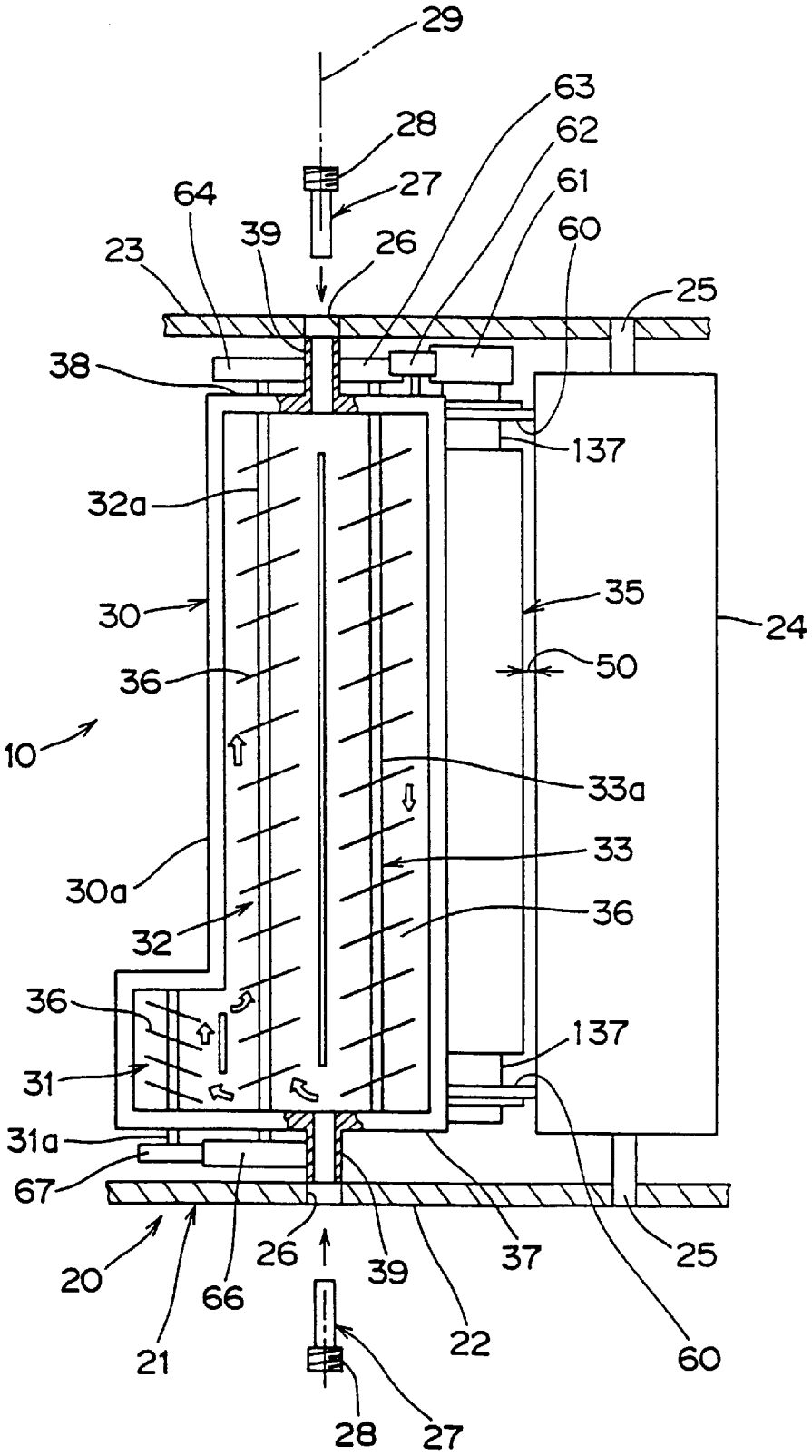
FIG. 2 is a schematic plan view of the imaging unit partly in section.

Referring to FIG. 2 illustrating a schematic plan view of the imaging unit 10 partly in section, the imaging unit 10 includes a drum unit 20 and a developer unit 30. The drum unit 20 includes a casing 21 having a first end face 23 on the first side and a second end face 22 on the second side, which support a support shaft 25 of the photoreceptor drum 24 in a rotatable manner.

The developer unit 30 has a container-like casing 30a containing a developer agent, and is adapted to supply the developer agent to a developer roller 35 sequentially through first, second and third stirring members 31, 32 and 33 arranged in parallel in the casing 30a. The stirring members 31 to 33 each have a spiral vane 36, and are adapted to transport the developer agent in a direction indicated by white arrows in FIG. 2 while stirring the developer agent by way of rotation thereof.

The casing 30a of the developer unit 30 has a first end face 38 on the first side and a second end face 37 on the second side, each of which has a cylindrical projection 39 projecting outwardly thereof and formed integrally therewith. Support shafts 27 respectively extending through threaded holes 26 formed in the opposite end faces 22 and 23 of the drum unit 20 are respectively fitted in hollow inside portions of the cylindrical projections 39. Thus, the developer unit 30 is supported rotatably about the support shafts 27 (i.e., an axis 29 defined by a common center axis of the support shafts 27). Each of the support shafts 27 has a threaded portion 28 formed integrally therewith on a rear end portion thereof and adapted to be fitted in the threaded hole 26.

The developer unit 30 supports the developer roller 35 rotatably about its support shaft 137. Spacing regulation sleeves 60 are respectively fitted rotatably around opposite end portions of the support shaft 137 of the developer roller 35. The spacing regulation sleeves 60 abut against the circumference of the photoreceptor drum 24 so as to regulate a DS spacing 50 between the photoreceptor drum 24 and the developer roller 35 for supplying the developer agent to the photoreceptor drum 24. The DS spacing 50 is regulated, for example, to 0.1 mm.

Figure 3:
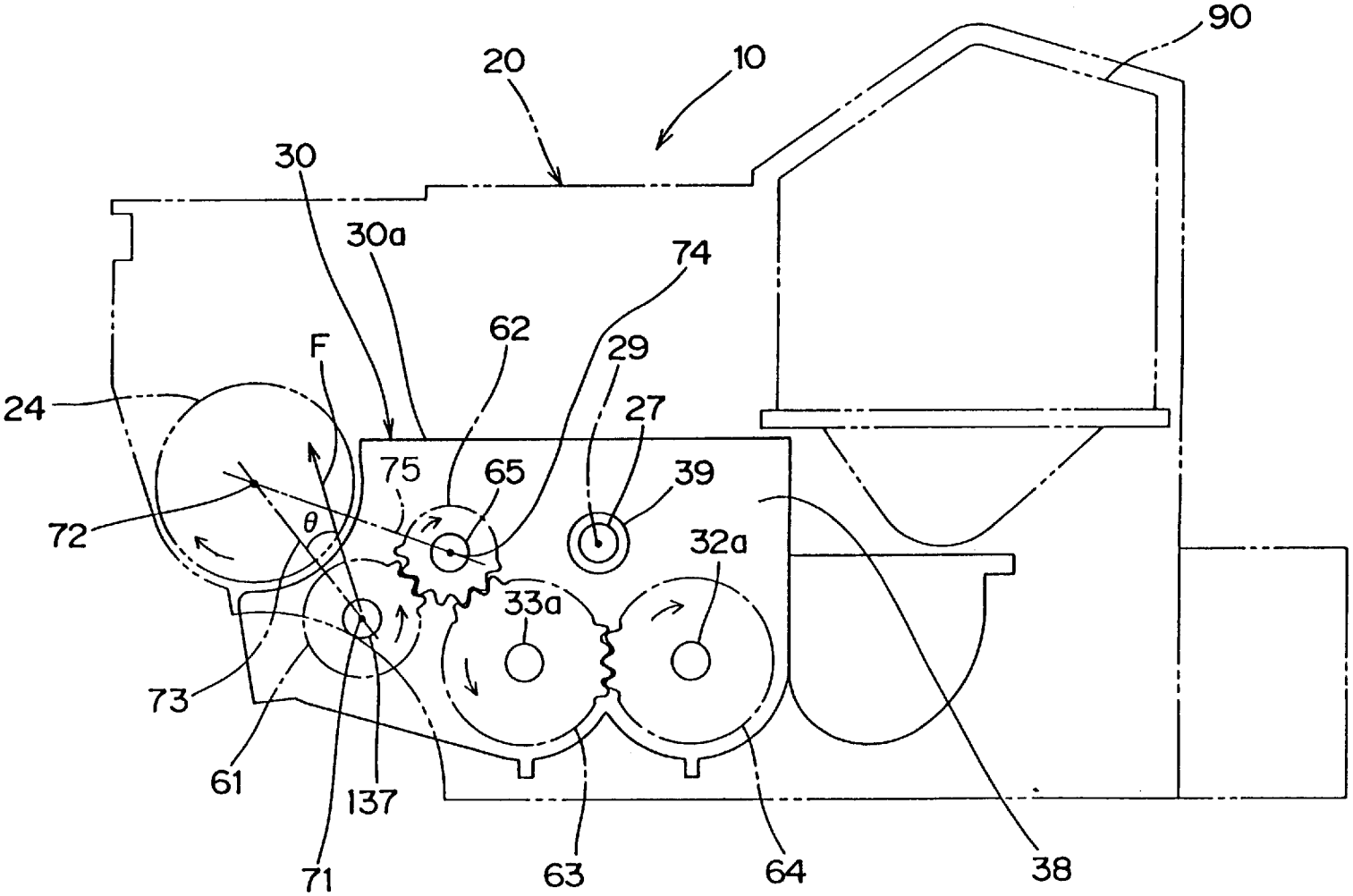
FIG. 3 is a schematic view illustrating an end face of a developer unit as viewed from a side opposite to a side from which the imaging unit is drawn out.

Referring to FIG. 2 and FIG. 3 illustrating the developer unit 30 as viewed from the first side, the support shaft 137 of the developer roller 35 and support shafts 32a and 33a of the second and third stirring members 32 and 33 are exposed to the first end face 38 of the developer unit 30. A driven gear 61 is attached to the support shaft 137 of the developer roller 35 for integral rotation therewith, and drive transmission gears 63 and 64 are attached to the support shafts 32a and 33a of the second and third stirring members 32 and 33, respectively, for integral rotation therewith.

A drive transmission gear 62 as an idling gear is interposed between the driven gear 61 and the drive transmission gear 63, and supported rotatably with respect to the first end face 38 by the support shaft 65. A driving force is transmitted to the driven gear 61 sequentially through the drive transmission gear 64, the drive transmission gear 63 and the drive transmission gear 62. Thus, the drive transmission gears 62 and 64 are rotated clockwise as seen in FIG. 3, while the drive transmission gear 63 and the driven gear 61 are rotated counterclockwise.

A force F exerted on the support shaft 137 of the driven gear 61 by the driving force transmitted from the drive transmission gear 62 to the driven gear 61 generates a clockwise moment about the rotation axis 29. Thus, the spacing regulation sleeve 60 fitted around a first end portion of the support shaft 137 of the developer roller 35 on the first side is pressed against the photoreceptor drum 24.

The force F is preferably exerted along a line which is inclined toward the drive transmission gear 62 at an angle 0 of 0 to 90° with respect to a plane 73 including a rotation axis 71 of the driven gear 61 and a rotation axis 72 of the photoreceptor drum 24. The spacing regulation sleeve 60 on the first side of the developer roller 35 provided with the driven gear 61 can be pressed against the photoreceptor drum 24 by the force F exerted along the line defined above.

In order to effectively press the spacing regulation sleeve 60 against the photoreceptor drum, it is more preferable that the force F is exerted along a line perpendicular (or normal) or generally perpendicular to a plane 75 (see FIG. 3) including the rotation axis 71 of the driven gear 61 and a rotation axis 74 of the drive transmission gear 62. In practice, the direction of the force F is determined in consideration of pressure angles of the gears 61 and 62.

Further, the support shafts 65, 33a and 32a of the drive transmission gears 62, 63 and 64 respectively receive forces resulting from the transmission of the driving force, and the developer unit 30 is rotatively biased in the aforesaid direction by application of a resultant of moments generated about the rotation axis 29 from the respective forces, in practice.

However, it is practically reasonable to take into consideration only the force to be exerted on the driven gear 61 as the rotative biasing force to be applied to the developer unit 30. This is because a distance between the driven gear 61 and the rotation axis 29 of the developer unit 30 is greater than any of distances from the rotation axis 29 of the developer unit 30 to the drive transmission gears 62, 63 and 64 so that the moment around the rotation axis 29 resulting from the force exerted on the driven gear 61 by the transmission of the driving force is greater than any of moments generated with respect to the other gears 62, 63 and 64.

Since the drive transmission gear 62 engaged with the driven gear 61 serves as an idling gear, the direction of the force to be exerted on the driven gear 61 is readily controlled. This is because the layout of the idling gear is relatively flexible.

The photoreceptor drum 24 and the driven gear 61 are driven by different driving systems. In FIG. 3, a reference numeral 90 denotes a toner hopper for supplying the toner to the first stirring member 31.

Figure 4:
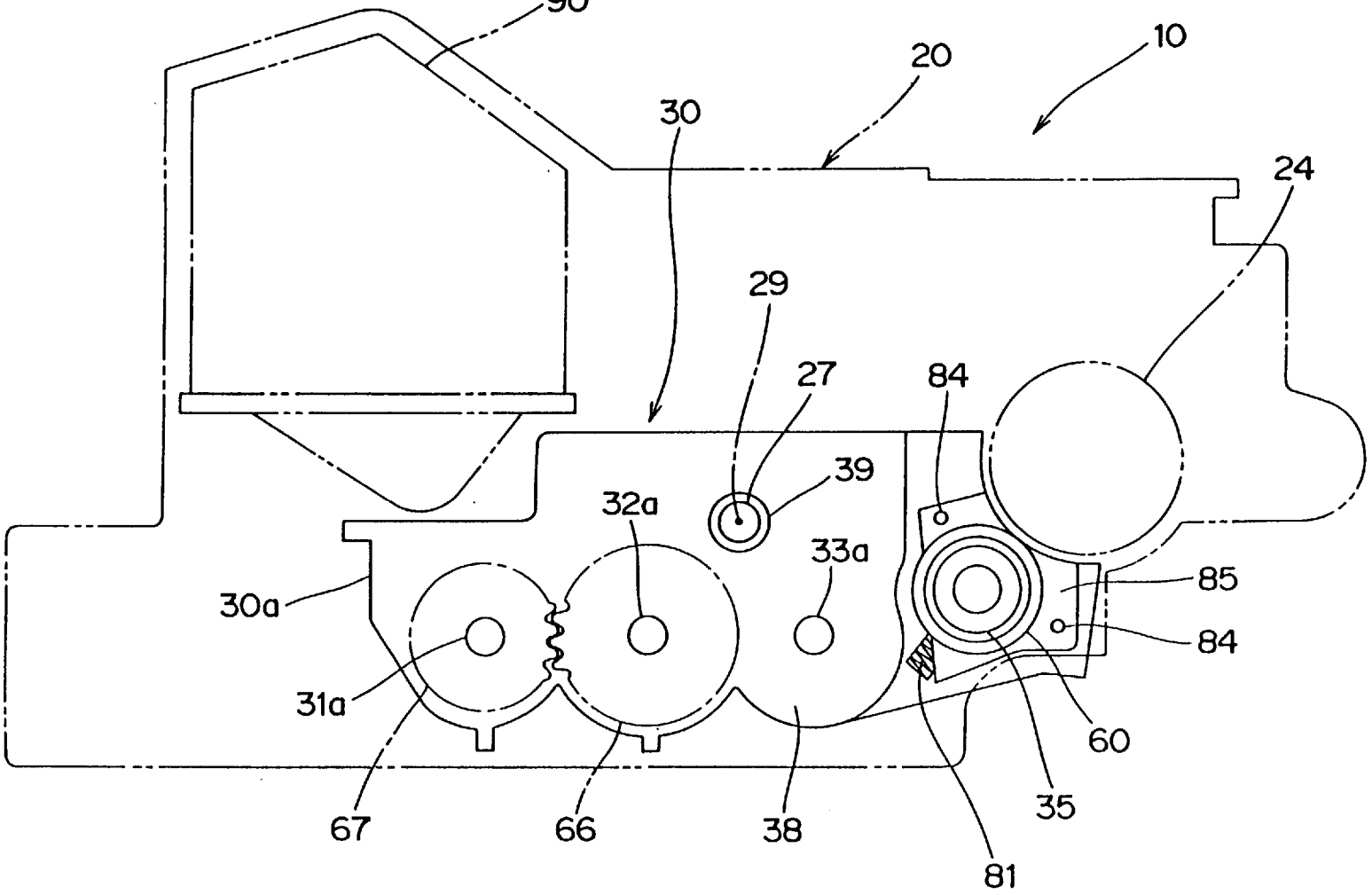
FIG. 4 is a schematic view illustrating an end face of the developer unit as viewed from the side from which the imaging unit is drawn out.

Referring to FIG. 2 and FIG. 4 illustrating the developer unit 30 as viewed from the second side, the support shafts 31a, 32a and 33a of the first, second and third stirring members 31, 32 and 33 are exposed to the second end face 37 of the developer unit 30. A drive transmission gear 67 is engaged with the support shaft 31a of the first stirring member 31 for integral rotation therewith, and a drive transmission gear 66 which is threadingly engaged with the drive transmission gear 67 is engaged with the support shaft 32a of the second stirring member 32 for integral rotation therewith.

Figure 5:
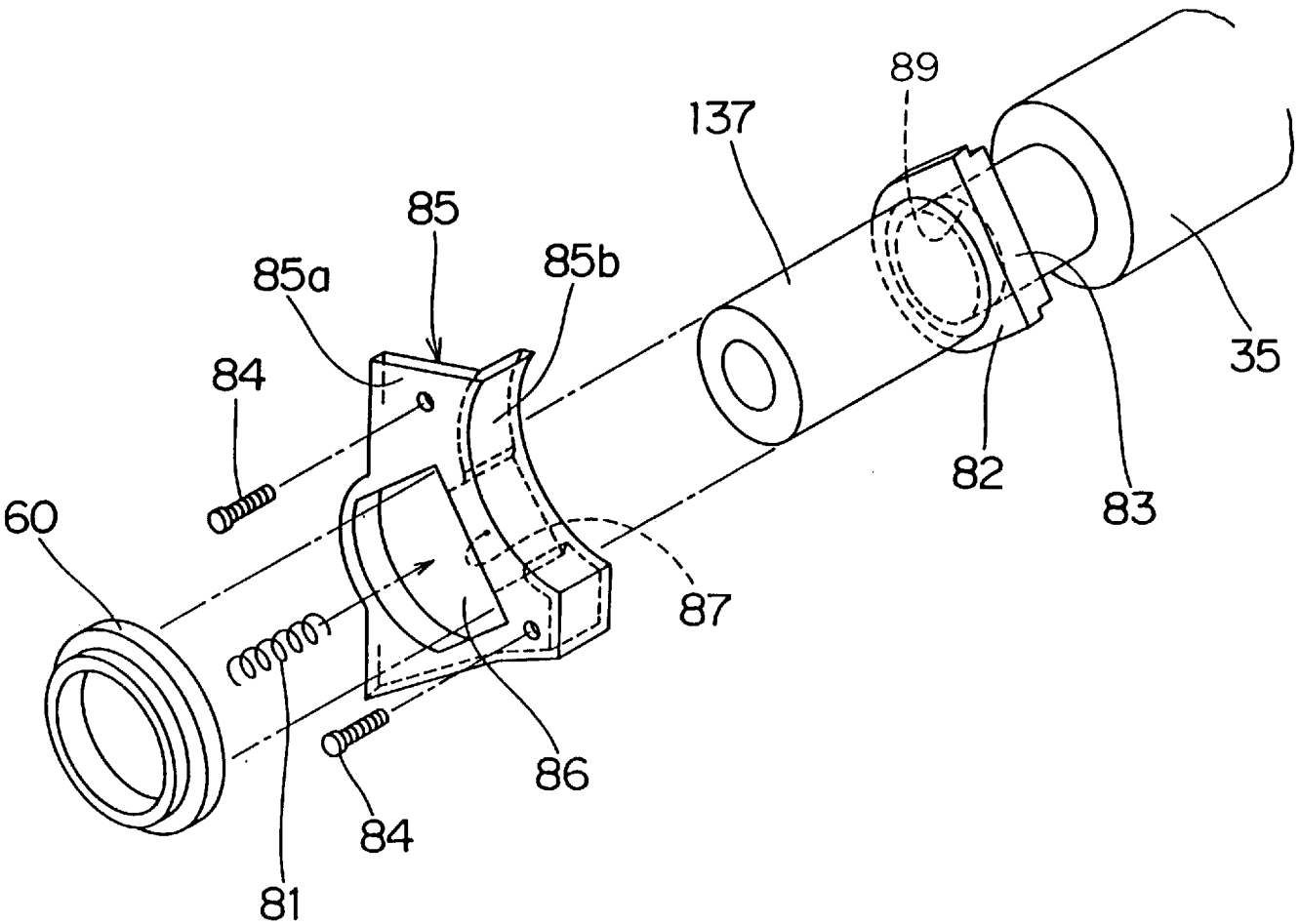
FIG. 5 is an exploded perspective view illustrating a structure for biasing a shaft of a developer roller toward a photoreceptor drum.
Figure 6:
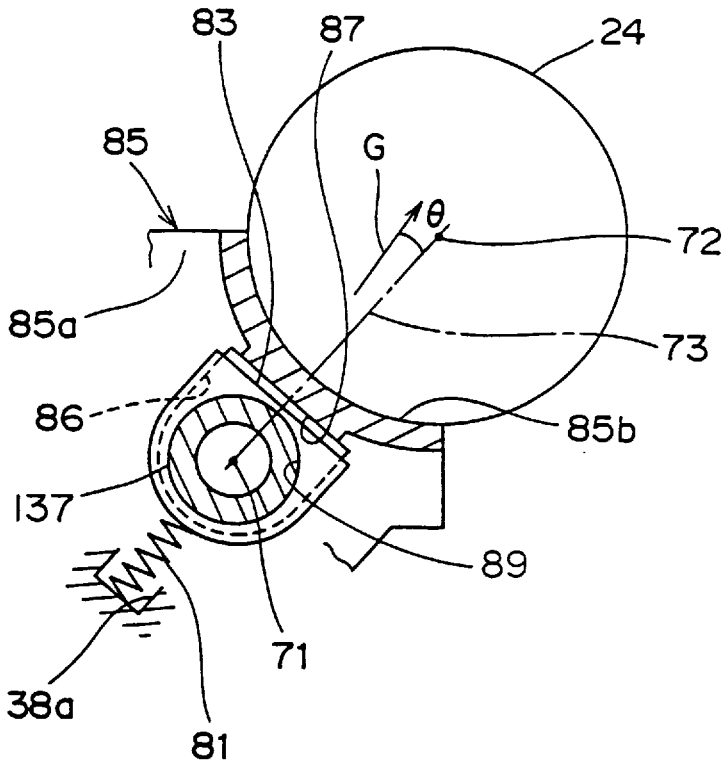
FIG. 6 is a sectional view illustrating the structure for biasing the shaft of the developer roller toward the photoreceptor drum.

The spacing regulation sleeve 60 fitted around a second end portion of the support shaft 137 of the developer roller 35 on the second side is resiliently biased against the photoreceptor drum 24 by a resilient member 81 such as a compression coil spring. The resiliently biasing structure will next be described with reference to FIG. 5 (exploded perspective view) and FIG. 6 (schematic sectional view).

An annular member 82 as a second member is fitted around the support shaft 137 of the developer roller 35. The axial movement of the annular member 82 is restricted by a stepped portion of the support shaft 137. Further, the annular member 82 has a round support hole 88 rotatably supporting the support shaft 137 therein and a planar abutment surface 83.

An attachment member 85 as a first member is fixed to the second end face 37 of the developer unit 30 by a pair of screws 84. The attachment member 85 has a first portion 85a fitted on the second end face 37 and a second portion 85b of a curved shape which is fitted on the circumference of an end portion of the photoreceptor drum 24 to serve as a sealing member for prevention of toner scattering.

The first portion 85a has a support hole 86 supporting the support shaft 137 with play with the annular member 82 intervening therebetween. A planer abutment surface 87 is formed on the back side of the second portion 85b followed by a portion of an interior surface of the support hole 86. It is noted that the annular member 82 and the attachment member 85 are not shown in FIG. 2.

The resilient member 81 is disposed between a receiving portion 38a recessed in a predetermined position of the second end face 37 and the annular member 82, and is adapted to bias the support shaft 137 toward the photoreceptor drum 24 to press the spacing regulation sleeve 60 against the photoreceptor drum 24.

The abutment surface 83 of the annular member 82 has the same inclination angle as the abutment surface 87 of the attachment member 85, and the play of the support shaft 137 within the support hole 86 is restricted by the abutment between the abutment surfaces 83 and 87. A line normal to the abutment surfaces 83 and 87 and a line along which a biasing force G is exerted by the resilient member 81 extend in the same direction as the direction of the force F (which is inclined at an angle 0 with respect to the plane 73 including the rotation axes 71 and 72). This prevents the developer roller 35 from being twisted with respect to the photoreceptor drum 24.

In accordance with this embodiment, the driving force applied to the developer roller 35 at the first end of the developer roller 35 for rotation thereof is utilized to bias the developer roller 35 toward the photoreceptor drum 24 via the spacing regulation sleeve 60 for the positioning of the developer roller 35 with respect to the photoreceptor drum 24. This arrangement obviates the need for additionally providing a spring member for biasing the developer roller 35 toward the photoreceptor drum 24 and a structure for supporting the spring member at the first end of the developer roller 35, thereby reducing component costs and assembly costs to lower the production costs.

Although the embodiment described above employs the plurality of drive transmission gears 62, 63 and 64, this arrangement is not critical but provision of at least one drive transmission gear may suffice for this purpose.

The embodiment described above is not limitative of the present invention, but various modifications may be made without departing from the scope of the appended claims.

What is claimed is:

1. An imaging unit comprising:

a drum unit rotatably supporting a photoreceptor drum;

a developer unit supported with respect to the drum unit pivotally about a predetermined rotation axis thereof, the developer unit including:

a casing;

a developer roller;

a support shaft having first and second ends and supporting the developer roller for integral rotation therewith;

first and second spacing regulation sleeves respectively engaged with the first and second ends of the support shaft, and adapted to abut against a circumference of the photoreceptor drum for regulating a spacing between the developer roller and the photoreceptor drum;

a driven gear provided at the first end of the support shaft for integral rotation therewith;

a drive transmission gear rotatably supported by the casing for transmitting a driving force to the driven gear;

a resilient member for pressing the second spacing regulation sleeve against the circumference of the photoreceptor;

a first member fixed to an end face of the casing of the developer unit and having a support hole; and a second member supported by the support hole of the first member so as to be slidable radially of the support shaft of the developer roller, the first end of the support shaft being rotatably supported in such a manner that radial movement thereof is restricted by the casing of the developer unit, the second end of the support shaft being supported by the casing of the developer unit so as to be movable toward and away from the photoreceptor drum, the developer unit being adapted to be biased rotatively about the predetermined axis by the driving force transmitted from the drive transmission gear to the driven gear so that the first spacing regulation sleeve is pressed against the photoreceptor drum the second member having a support hole rotatable supporting the second end of the support shaft of the developer roller, and the resilient member being interposed between the casing of the developer unit and the second member for biasing the second member toward the photoreceptor drum.

2. An imaging unit as set forth in claim 1, wherein the support shaft of the driven gear receives a force exerted by the transmission of the driving force along a line which intersects a plane including a rotation axis of the photoreceptor drum and a rotation axis of the drive transmission gear and is inclined at an angle of 0 to 90 degrees with respect to a plane including a rotation axis of the driven gear and the rotation axis of the photoreceptor drum.

3. An imaging unit as set forth in claim 2, wherein the line along which the force is exerted on the support shaft of the driven gear by the transmission of the driving force extends generally perpendicularly to the plane including the rotation axis of the photoreceptor drum and the rotation axis of the drive transmission gear.

4. An imaging unit as set forth in claim 1, wherein a direction in which the second spacing regulation sleeve is pressed by the resilient member is the same as a direction in which a force exerted on the support shaft of the driven gear by the transmission of the driving force when viewed along an axis of the support shaft.

5. An imaging unit as set forth in claim 1, wherein the drive transmission gear includes a plurality of gear members for transmitting the driving force sequentially therethrough.

6. An imaging unit as set forth in claim 5, wherein the plurality of gear members includes:

a stirrer driving gear member engaged with an end of a support shaft of a stirrer for conveying and stirring a developer agent contained in the casing of the developer unit in an integrally rotatable manner; and an idling gear member interposed between the stirrer driving gear member and the driven gear.

7. An imaging unit as set forth in claim 5, wherein the developer unit is biased rotatively about the predetermined axis by a resultant of forces exerted on the plurality of gear members and on the driven gear by the transmission of the driving force.

8. An imaging unit as set forth in claim 1, wherein the first member has a curved sealing portion fitted on a circumference of an end portion of the photoreceptor drum for prevention of toner scattering.

9. An imaging unit comprising:

a drum unit rotatably supporting a photoreceptor drum;

a developer unit supported with respect to the drum unit pivotally about a predetermined rotation axis thereof, the developer unit including:

a casing;

a developer roller;

a support shaft having first and second ends and supporting the developer roller for integral rotation therewith;

first and second spacing regulation sleeves respectively engaged with the first and second ends of the support shaft, and adapted to abut against a circumference of the photoreceptor drum for regulating a spacing between the developer roller and the photoreceptor drum;

a driven gear provided at the first end of the support shaft for integral rotation therewith;

a drive transmission gear rotatable supported by the casing for transmitting a driving force to the driven gear, the drive transmission gear including a plurality of gear members for transmitting the driving force sequentially therethrough; and a resilient member for dressing the second spacing regulation sleeve against the circumference of the photoreceptor drum, the first end of the support shaft being rotatably supported in such a manner that radial movement thereof is restricted by the casing of the developer unit, the second end of the support shaft being supported by the casing of the developer unit so as to be movable toward and away from the photoreceptor drum, the developer unit being adapted to be biased rotatively about the predetermined axis by the driving force transmitted from the drive transmission gear to the driven gear so that the first spacing regulation sleeve is pressed against the photoreceptor drum, wherein a distance between the predetermined rotation axis and the driven gear is greater than any of distances from the predetermined rotation axis to the plurality of gear members.

* * * * *